US005993644A

United States Patent [19]

Xiao et al.

[11] Patent Number: 5,993,644

[45] Date of Patent: Nov. 30, 1999

[54] BASE STOCK LUBE OIL MANUFACTURING PROCESS

[75] Inventors: Jirong Xiao, Oakland; Phil Winslow, Hercules; James N. Ziemer, Martinez, all of Calif.

[73] Assignee: Chevron U.S.A. Inc., San Francisco, Calif.

[21] Appl. No.: 08/883,001

[22] Filed: Jun. 26, 1997

Related U.S. Application Data

[60] Provisional application No. 60/021,834, Jul. 16, 1996.

[51] Int. Cl.[6] ..... C10G 45/60

[52] U.S. Cl. ..... 208/89; 208/259; 208/87; 208/114; 208/57; 208/118; 208/97; 208/111; 208/58; 208/61

[58] Field of Search ..... 208/97, 89, 28, 208/259, 57, 58, 118, 61

[56] References Cited

U.S. PATENT DOCUMENTS

| | | | |
|---|---|---|---|
| 2,779,713 | 10/1957 | Cole et al. . | |
| 3,486,993 | 12/1969 | Egan et al. | 208/89 |
| 3,663,422 | 5/1972 | Dunn | 208/28 |
| 3,673,078 | 6/1972 | Kirk, Jr. | 208/89 |
| 3,759,823 | 9/1973 | Davies et al. | 208/138 |
| 3,779,896 | 12/1973 | Woodle | 208/86 |
| 4,181,598 | 1/1980 | Gillespie et al. | 208/58 |
| 4,294,687 | 10/1981 | Pinaire et al. | 208/89 |
| 4,387,258 | 6/1983 | Vadekar et al. | 585/259 |
| 4,394,249 | 7/1983 | Shen | 208/89 |
| 4,437,975 | 3/1984 | Gillespie et al. | 208/87 |
| 4,437,976 | 3/1984 | Oleck et al. | 208/97 |
| 4,563,266 | 1/1986 | Hopkins et al. | 208/120 |
| 4,564,440 | 1/1986 | Garwood et al. | 208/87 |
| 4,610,778 | 9/1986 | Graven | 208/89 |
| 4,622,129 | 11/1986 | Bayle et al. | 208/87 |
| 4,636,299 | 1/1987 | Umuth et al. | 208/87 |
| 4,669,707 | 6/1987 | Moorehead et al. | 208/57 |
| 4,695,365 | 9/1987 | Ackelson et al. | 208/89 |
| 4,699,707 | 10/1987 | Moorehead et al. | 208/57 |
| 4,747,932 | 5/1988 | Miller | 208/97 |
| 4,755,279 | 7/1988 | Umuth et al. | 208/87 |
| 4,795,546 | 1/1989 | Miller | 208/97 |
| 4,822,476 | 4/1989 | Ziemer et al. | 208/59 |
| 4,913,797 | 4/1990 | Albinson et al. | 208/89 |
| 4,921,594 | 5/1990 | Miller | 208/58 |
| 5,149,421 | 9/1992 | Miller | 208/114 |
| 5,346,874 | 9/1994 | Clark et al. | 502/207 |
| 5,376,260 | 12/1994 | Santilli et al. | 208/111 |
| 5,393,408 | 2/1995 | Ziemer et al. | 208/57 |
| 5,397,454 | 3/1995 | Zones et al. | 208/46 |
| 5,413,695 | 5/1995 | Miller | 208/28 |
| 5,543,035 | 8/1996 | Ziemer | 208/111 |

FOREIGN PATENT DOCUMENTS

| | | |
|---|---|---|
| 986051 | 3/1976 | Canada . |
| 18808 | of 0000 | European Pat. Off. . |
| 373740 | 6/1996 | European Pat. Off. . |
| 0 743 351 A2 | 11/1996 | European Pat. Off. . |
| 0 744 452 A2 | 11/1996 | European Pat. Off. . |
| 2104406 | of 0000 | United Kingdom . |
| 1310320 | 3/1973 | United Kingdom . |

*Primary Examiner*—Helane Myers
*Attorney, Agent, or Firm*—Alan W. Klaassen

[57] ABSTRACT

A process is provided for preparing high quality Group II and Group III lubricating base oils from a sulfur containing feedstock using mild hydrotreating followed by isomerization/dewaxing followed by hydrogenation over a sulfur resistant hydrogenation catalyst.

44 Claims, No Drawings

BASE STOCK LUBE OIL MANUFACTURING PROCESS

CROSS-REFERENCE TO RELATED APPLICATIONS

This application claims priority from and the benefit of U.S. Provisional Application No. 60/021,834, filed Jul. 16, 1996.

FIELD OF THE INVENTION

The present invention is directed to a catalytic process for producing a lubricating oil base stock.

BACKGROUND OF THE INVENTION

Crude petroleum is distilled and fractionated into many products such as gasoline, kerosene, jet fuel, asphaltenes, and the like. One portion of the crude petroleum forms the base of lubricating oil base stocks used in, inter alia, the lubricating of internal combustion engines.

The manufacture of lubricating base oils from crude petroleum oil is typically a multi-step process, though there are many variations in the specifics of the processing steps, throughout the industry. Each lube manufacturing facility may include one or more of an upgrading step to remove heteroatoms and to increase the viscosity index of the final lube oil product, a dewaxing step to remove undesirable wax from the oil, and a finishing step to stabilize the oil to oxidation and thermal degradation. However, lube oil users are demanding every increasing base oil quality, and refiners are finding that their available equipment is becoming less and less able to produce base stocks which meet these product specifications. New processes are required to provide refiners with the tools for preparing the modem base oils using existing equipment at lower cost and with safer operation.

Bayle, et al., in U.S. Pat. No. 4,622,129, discloses a method of solvent extraction followed by hydrotreating to produce consistently high quality lube oils. In the '129 method, a formula relating to lube oil properties and hydrotreating conditions is proposed for adjusting the extraction depth of the base oils to be hydroprocessed.

Dun, et al. in U.S. Pat. No. 3,663,422, discloses a process for producing very high-viscosity-index lubricating oils by hydrotreating a solvent-refined asphalt-free waxy hydrocarbon oil in the presence of a sulfided catalyst comprising a Group VI and/or Group VIII metal supported on a substantially non-acidic refractory oxide base. The hydrotreating conditions in '422 include a temperature in the range of from 420 to 460° C. and a pressure of from 165 to 225 kg/cm$^2$. In the '422 process, the hydrotreating step produces a dewaxed oil having a viscosity index of at least 125 and a viscosity at 210° F. (99° C.) of at least 9 centistokes.

Miller, in U.S. Pat. No. 5,413,695, teaches a process for producing lube oil from a solvent refined gas oil, using an intermediate pore size silicoaluminophosphate molecular sieve and at least one Group VII metal under dewaxing and isocracking conditions.

Shen, in U.S. Pat. No. 4,394,249, discloses a hydrodesulfurization process for removing from 50 to 99.5% by weight of sulfur in a lube oil feedstock prior to dewaxing the feedstock in a distillate dewaxing process unit. In the process, a lube oil feedstock is hydrodesulfurized and the effluent separated into a gaseous fraction and a liquid fraction. The liquid fraction is contacted in a catalytic dewaxing unit with a highly siliceous zeolite ZSM-5 type porous crystalline material, and the effluent conducted to a heat exchanger. The gaseous fraction from the hydrotreater is also conducted to the heat exchanger, heated by exchanging heat with the effluent from the catalytic dewaxing unit and conducted to the catalytic dewaxing unit.

Ackelson, in U.S. Pat. No. 4,695,365, discloses a process for hydrotreating and hydrodewaxing a spindle oil in the presence of a catalyst containing at least 70 percent by weight of an intermediate pore molecule sieve in a support. In the preferred process of '365, substantial amounts of sulfur and nitrogen are removed during the process, but the viscosity of the spindle oil remains largely unchanged. Thus, the viscosity of the spindle oil, measured at 100° C., differs from the feed entering the hydrotreating stage by no more than 1.75 centistokes.

Woodle, in U.S. Pat. No. 3,779,896, teaches a preparation of lubricating oil comprising simultaneous deasphalting-solvent refining of a residuum containing petroleum fraction, and hydrocracking the raffinate phase with a hydrocracking catalyst at a temperature between 600° and 900° F. (316° C. and 482° C.), a pressure between 800 and 5,000 psig (5.6–34.6 MPa), a space velocity between 1.0 and 5.0 v/v/hr. and a hydrogen rate between 500 and 20,000 scf/bbl (i.e., standard cubic feet per barrel) (89.1–3600 std m$^3$ $H_2$/m$^3$ oil).

API Publication 1509: Engine Oil Licensing and Certification System, "Appendix E-API Base Oil Interchangeability Guidelines for Passenger Car Motor Oil and Diesel Engine Oils" describes base stock categories. A Group II base stock contains greater than or equal to 90 percent saturates and less than or equal to 0.03 percent sulfur and has a viscosity index greater than or equal to 80 and less than 120. A Group III base stock contains greater than or equal to 90 percent saturates and less than or equal to 0.03 percent sulfur and has a viscosity index greater than or equal to 120. In order to prepare such high quality oils from straight run petroleum stock conventionally requires very severe operating conditions, including, for example, reaction over a hydrocracking catalyst at a hydrogen pressure generally above 2000 psia (13.8 MPa) and a reaction temperature above about 725° F. (385° C.), or solvent extraction at high solvent/oil ratios and high extraction temperatures. While effective for preparing the base stocks, these conventional processes are expensive to operate, and yields of base stock are often low. It is desirable to have a process for preparing the Group II and Group III base stocks at lower operating cost, at lower equipment cost and with improved operator safety.

SUMMARY OF THE INVENTION

The present invention provides a process for producing a lubricating oil base stock, the process comprising a hydrotreating step, a dewaxing step and a hydrogenation step. Among other factors, the present process is based on the discovery of a surprisingly effective and low cost process for making a lubricating oil base stock. The low cost is realized, in part, by the mild conditions required in the hydrotreating step. In conventional processing, hydrotreating under severe reaction conditions is often required to produce a desired low sulfur, high viscosity index product for dewaxing and stabilizing by hydrogenation. In the present process, a high quality oil, such as a Group II or a Group III oil, is produced using only mild hydrotreating conditions of temperature and pressure. Such mild operating conditions are possible because of the additional benefit achieved with the dewaxing catalyst and the hydrogenation catalyst of the present invention. In particular, a hydrogenation catalyst, comprising a platinum/palladium alloy, has been found to be particularly active for the hydrogenation of a lubricating oil base stock, particularly when the base stock has high levels of sulfur, e.g. greater than 20 ppm sulfur. This resistance to sulfur poisoning permits, in part, the operation of the hydrotreating step at mild conditions, even when a high quality lubricating oil base stock such as a Group II or a Group III oil is desired. Such mild conditions result in significantly lower cost of operation of the process relative to conventional processes.

Accordingly, a process is provided for producing a lubricating oil base stock comprising:

a) contacting a petroleum feedstock which has a normal boiling point in the range of about 600° F. (316° C.) to about 1250° F. (677° C.) in a hydrotreating reaction zone with a hydrotreating catalyst at a hydrogen partial pressure of less than about 1600 psia (11 MPa) and a temperature between about 500° F. (260° C.) and about 800° F. (427° C.) to produce a hydrotreated oil having a viscosity index which is at least about 5 greater than the viscosity index of the petroleum feedstock and a viscosity measured at 100° C. of at least about 2 cSt;

b) contacting the hydrotreated oil at hydrodewaxing conditions in a dewaxing reaction zone with an intermediate pore size molecular sieve catalyst to produce a dewaxed oil having a pour point lower than the pour point of the hydrotreated oil; and c) contacting the dewaxed oil at hydrogenation conditions in a hydrofinishing reaction zone with a hydrogenation catalyst comprising a platinum/palladium alloy to produce a lubricating oil base stock, wherein the platinum/palladium molar ratio of the platinum/palladium alloy is between about 2.5:1 and about 1:2.

Further to the invention is provided a process for producing a lubricating oil comprising upgrading a petroleum feedstock to produce a lube oil feedstock having a viscosity index higher than that of the petroleum feedstock; and reacting the lube oil feedstock at hydrotreating conditions selected to maintain a volumetric cracking conversion during hydrotreating of less than 20%, preferably less than 10%, more preferably less than 5%, and a sulfur content of the hydrotreated oil of less than 50 ppm, preferably less than 20 ppm and more preferably less than 10 ppm, wherein the change in viscosity index of the lube oil feedstock during hydrotreating, $(VI_H-VI_0)$ is such that $(VI_H-VI_0)/\Delta C$ is greater than 1.0 and preferably at least about 1.5, wherein $VI_H$ is the viscosity index of the hydrotreated oil, $VI_0$ is the viscosity index of the lube oil feedstock to the hydrotreater, and $\Delta C$ is the volumetric cracking conversion in the hydrotreater. Both $VI_0$ and $VI_H$ are on a dewaxed basis.

Further to the invention is a lubricating oil base stock containing less than 0.03% sulfur, greater than or equal to 90% saturates and a viscosity index of at least 80, preferably at least 95, which lubricating oil base stock is prepared from a lube oil feedstock containing at least 0.1% sulfur by a process comprising:

a) hydrotreating a petroleum feedstock having a viscosity index of at least about 75 in a hydrotreating reaction zone with a hydrotreating catalyst at a hydrogen partial pressure of less than about 1600 psig (11.1 MPa) and a temperature between about 500° F. (260° C.) and about 800° F. (427° C.) to produce a hydrotreated oil having a viscosity index which is at least about 5 greater than the viscosity index of the petroleum feedstock and a viscosity measured at 100° C. of at least about 2 cSt;

b) contacting the hydrotreated oil at hydrodewaxing conditions with an intermediate pore size molecular sieve catalyst to produce a dewaxed oil having a pour point which is lower than the pour point of the hydrotreated oil; and c) contacting the dewaxed oil at hydrogenation conditions in a hydrofinishing reaction zone with a hydrogenation catalyst comprising a platinum/palladium alloy to produce a lubricating oil base stock, wherein the platinum/palladium molar ratio of the platinum/palladium alloy is between about 2.5:1 and about 1:2.

The lubricating oil base stock prepared as described herein preferably meets the requirements of an aforementioned Group II base oil or a Group III base oil.

A surprising aspect of the present invention is that the preferred hydrogenation catalyst, which comprises a platinum/palladium alloy on an silica/alumina support, demonstrates a surprising tolerance to sulfur poisoning, such that a Group II or a Group III lubricating oil base stock may be produced from a high sulfur containing lube oil feedstock using only mild hydrotreating to prepare a hydrotreated effluent for hydrodewaxing. This is a contrast to the conventional process, which requires hydrocracking or solvent extraction at severe conditions in order to prepare an effluent suitable for hydrodewaxing in the preparation of the high quality Group II and Group III base oils.

DETAILED DESCRIPTION OF THE INVENTION

Feedstocks to the process may be one or a combination of refinery streams having a normal boiling point of at least about 600° F. (316° C.), although the process is also useful with oils which have initial boiling points as low as 436° F. (224° C.). By having a normal boiling point of at least about 600° F. (316° C.) is meant that about 85% by volume of the feedstock has a boiling point at atmospheric pressure of at least about 600° F. (316° C.). While higher boiling lube oil feedstocks may be processed as disclosed herein, the preferred feedstock will have a boiling range such that at least 85% by volume of the feedstock has a normal boiling point of at most about 1250° F. (677° C.), and more preferably at most about 1100° F. (593° C.). Representative feedstocks which may be treated using the present process include gas oils and vacuum gas oils (VGO), hydrocracked gas oils and vacuum gas oils, deasphalted oils, slack wax, foots oils, coker tower bottoms fraction, reduced crude, vacuum tower bottoms, deasphalted vacuum resids, FCC tower bottoms and cycle oils and raffinates from a solvent extraction process. The nitrogen, sulfur and saturate contents of these feeds will vary, depending on a number of factors. However, while the sulfur and nitrogen contents of the lube oil feedstock are not critical in the practice of the present invention, the present process is particularly useful for those feeds having high nitrogen and high sulfur contents. Thus feedstocks containing greater than 100 ppm sulfur or 200 ppm sulfur, or 400 ppm sulfur or even in the range of between from about 0.5% to about 2.5% by weight of sulfur may be suitably processed as described herein. The lube oil feedstock will also generally contain more than 50 ppm nitrogen, usually in the range from 50 ppm nitrogen to 2000 ppm (0.2 wt %) nitrogen. The high tolerance of the catalyst system for high feed sulfur levels permits using straight run VGO as a suitable feedstock. The use of such a feed greatly reduces overall processing cost. The preferred feedstock to the present process has a viscosity index of greater than about 75. In one embodiment, the feedstock will be a typical base oil feedstock having a viscosity index in the range of 75 to 90. In a separate embodiment, particularly when the feedstock contains significant amounts of wax, the viscosity index of the feedstock may be higher than 110 or 120 or even 130. For example, a lube oil feedstock such as a vacuum gas oil having a sulfur content of as high as 2.5% by weight and a normal boiling point of as high as 1250° F. (677° C.) may be processed according to the present process to produce a Group II or a Group III lubricating oil base stock.

The feedstock employed in the process of the invention may contain high amounts of wax, e.g. greater than 50% wax. Exemplary feedstocks containing high amount of wax include waxy distillate stocks such as gas oils, lubricating oil stocks, synthetic oils such as those by Fischer-Tropsch synthesis, high pour point polyalphaolefins, foots oils, synthetic waxes such as normal alphaolefin waxes, slack waxes, deoiled waxes and microcrystalline waxes. Foots oil is prepared by separating oil from the wax. The isolated oil is referred to as foots oil.

Slack wax can be obtained from either a hydrocracked lube oil or a solvent refined lube oil. Slack waxes possess a very high viscosity index, normally in the range of from 140 to 200, depending on the oil content and the starting material from which the wax has been prepared. Slack waxes are therefore eminently suitable for the preparation of lubricating oils having very high viscosity indices, i.e., from about 120 to about 180.

A refinery stream may desirably be treated in a mild solvent extraction process to prepare the lube oil feedstock. Solvent extraction used for preparing the lube oil feedstock for the present process is conventional, and does not require detailed description. The solvent extraction step is suitably carried out with solvents such as N-Methyl-2-pyrrolidone or furfural. The solvents are chosen for their relative solubilization of aromatic-type petroleum molecules and paraffin-type molecules, and for their relatively low boiling point, which permits ease of separation of the solvent from the extract. Solvent extractors, such as the rotating disc contactor, are used widely in preparing lubricating oils. Asphalt-containing feedstocks may be deasphalted prior to solvent extraction. Preferred solvents for deasphalting include lower-boiling paraffinic hydrocarbons such as ethane, propane, butane, pentane, or mixtures thereof. Propane deasphalting is preferred. Pentane is the most suitable solvent if high yields of deasphalted oil are desired. These lower-boiling paraffinic solvents may also be used as mixtures with alcohols such as methanol and isopropanol.

In conventional processes for preparing high quality lubricating oil base stocks, a solvent extraction process is often employed to upgrade a petroleum feedstock, such that sulfur, nitrogen and aromatic compounds are removed and the viscosity index of the extracted oil is increased relative to the extractor feedstock. The conventional solvent extraction severity is typically maintained at sufficient conditions to product an extracted oil product having a viscosity index of at least 80, and preferably at least 95, if a Group II oil is desired. If a Group III oil is desired, the extraction severity is sufficient to produce an extracted oil product having a viscosity index of at least 120.

A solvent extraction process for the preparation of a lube oil feedstock useful in the present method may be run at lower severity than is commonly employed in the preparation of high quality lubricating oil base stocks. Reduced solvent extraction severity is seen in reduced solvent usage and/or in reduced solvent extraction temperatures. Decreasing the amount of solvent required for the solvent extraction step results in higher yields in the extraction step, and simplifies the process for separating the solvent from the extract following the extraction step.

In the embodiment of the present process which includes a preliminary solvent extraction step, solvent extraction conditions may be maintained to produce an extracted oil product having a viscosity index which is at least 5 less, and preferably in the range of about 5 to about 20 less than the desired viscosity index of the lubricating oil base stock prepared in the present process. If the desired viscosity index of the Group II lubricating oil base stock is 80, the solvent extraction pre-treatment step of the present process is maintained to produce a lubricating oil feedstock having a viscosity index of less than about 75 and preferably in the range from about 60 to about 75. Likewise, if the desired viscosity index of the Group II lubricating oil base stock is 95, the solvent extraction pre-treatment step of the present process is maintained to produce a lubricating oil feedstock having a viscosity index of less than about 90 and preferably in the range from about 75 to about 90. Likewise, if the desired viscosity index of the Group III lubricating oil base stock, for example, is 120, the solvent extraction pre-treatment step of the present process is maintained to produce a lubricating oil feedstock having a viscosity index of less than about 115 and preferably in the range from about 100 to about 115.

The hydrotreating catalyst for the low severity hydrotreating process within the hydrotreating reaction zone contains one or a combination of hydrogenation metals on an oxide support material. Hydrogenation metals selected from Group VIA and Group VIIIA of the Periodic Table (IUPAC form), such as one or a mixture of nickel, tungsten, cobalt, molybdenum, platinum or palladium, are preferred. The hydrogenation metal(s) may be either in elemental form or in combination with other elements (e.g. sulfur, oxygen, halogen, nitrogen) on an oxide support material. If a combination of at least a Group VIA and a Group VIIIA metal component is present as (mixed) oxides, it will be subjected to a sulphiding treatment prior to proper use in hydrotreating. Suitably, the catalyst compositions to be used in the process according to the present invention comprise one or more components of nickel and/or cobalt and one or more components of molybdenum and/or tungsten or one or more components of platinum and/or palladium.

The amount(s) of hydrogenation component(s) in the catalyst compositions suitably range from about 0.5% to about 10% by weight of Group VIIIA metal component(s) and from about 5% to about 25% by weight of Group VIA metal component(s), calculated as metal(s) per 100 parts by weight of total catalyst. The preferred catalyst compositions in accordance with the present invention comprise about 3%–10% by weight of nickel and from about 5%–20% by weight molybdenum. More preferably, the catalyst compositions in accordance with the present invention comprise from about 4%–8% by weight of nickel and from about 8%–15% by weight molybdenum, calculated as metals per 100 parts by weight of total catalyst.

Catalysts useful as hydrotreating catalysts of the present invention may be prepared in a process comprising mixing or comulling active sources of the hydrogenation metals with active sources of the oxide support material. Other components of the catalyst may also be added before or during mixing. The mixed components may then be shaped, e.g. by extrusion, and the shaped catalyst precursor heated to form the catalyst. Such methods are well-known in the art.

The hydrotreating catalyst may further comprise molecular sieves such as the SAPO's, e.g. SAPO-11, SAPO-5, SAPO-31, SAPO-41, faujasite-type zeolites such as Y, X, A, ultrastable Y, other zeolites such as Beta and intermediate pore zeolites such as ZSM-5, SSZ-32, ZSM-23, ZSM-25. If crystalline materials are included in the hydrotreating catalyst, low-activity, low-acid forms of the crystalline materials are preferred. When such a crystalline material is present in the hydrotreating catalyst, the catalyst will generally contain less than 10% of the crystalline material, and preferably less than 8%. For example, a suitable hydrotreating catalyst contains a Y-type zeolite having a unit cell size less than about 24.50 angstroms and preferably less than about 24.35 angstroms, a bulk silica to alumina mole ratio of greater than 5, preferably greater than about 25, and an alkali(ne earth) metal content of less than 0.3 percent by weight basis metal.

The oxide support material will include one or more of silica, alumina, magnesia, titania, zirconia, silica-alumina or combinations thereof. Both amorphous and crystalline binders can be applied. Preference is given to the use of alumina as the oxide support material.

The process of the present invention is characterized by low severity hydrotreating conditions, with little, if any, conversion of the lube oil feedstock to low boiling hydrotreated products. Hydrotreating conditions are selected to maintain the volumetric cracking conversion during hydrotreating to less than 20%, preferably less than 10% and more preferably less than 5%. As used herein, the volumetric cracking conversion is a measure, in volume percent, of the lube oil feedstock which is converted during hydrotreating into reaction products having a normal boiling point less than a reference temperature $T_{ref}$, wherein:

$$T_{ref}=T_{50}-2.5(T_{50}-T_{30}),$$

and wherein $T_{50}$ and $T_{30}$ are equal to the normal boiling point temperature of 50% and 30% by volume, respectively, according to a D2887 simulated distillation, of the lube oil feedstock to the hydrotreater. Thus, the hydrotreating reaction zone which contains the hydrotreating catalyst of this invention is maintained at a hydrogen partial pressure of less than about 1600 psia (11 MPa), preferably less than about 1250 psig (8.7 MPa) and more preferably less than about 1100 psia (7.6 MPa), and at a temperature between about 500° F. (260° C.) and about 800° F. (427° C.), preferably between about 600° F. (316° C.) and about 700° F. (371° C.). The feed rate is suitably maintained within the range of between about 0.1 $hr^{-1}$ and about 10 $hr^{-1}$ LHSV, and preferably between about 0.1 $hr^{-1}$ and about 5 $hr^{-1}$, wherein the term LHSV (i.e. liquid hourly space velocity) represents the rate at which the feed is introduced to the reaction zone, in this case the hydrotreating reaction zone. The units of LHSV are in volume of feed per volume of catalyst per hour, or $hr^{-1}$. In order to maintain sufficient hydrogen in contact with the hydrotreating catalyst during the hydrotreating reactions, a hydrogen stream, generally containing greater than 50 mole percent hydrogen is introduced into the hydrotreating reaction zone at a rate of at least 1000 SCF/barrel of petroleum feedstock (178.1 std $m^3$ $H_2/m^3$ oil).

During hydrotreating according to the present invention, the viscosity index of the hydrotreated oil is increased significantly, with relatively little yield loss. For example, in conventional hydrocracking for increasing the viscosity index of a lube base oil feedstock, the visosity index of the product generally increases by less than about 1 viscosity index unit for each 1% in conversion. In contrast, the hydrotreated oil of the present invention has a viscosity index of at least $VI_H$, wherein $$\frac{(VI_H - VI_o)}{\Delta C} > 1.0.$$

ΔC is the conversion during the step of hydrotreating; and $VI_o$ is the viscosity index of the petroleum feedstock.

Preferably, $$\frac{(VI_H - VI_o)}{\Delta C} \geq 1.5.$$

Even more preferably, $$\frac{(VI_H - VI_0)}{\Delta C} \geq 2.0.$$

Thus, during hydrotreating according to the present process, the viscosity index of the petroleum feedstock is increased by at least 5 viscosity index units, and preferably increased by between about 5 and about 25 viscosity index units, wherein the viscosity index of the petroleum feedstocks and of the hydrotreated oil are on a dewaxed basis.

As used herein, the derivation of viscosity index is described in ASTM D2270-86. The viscosity index is based on measured viscosities at 40° C. and at 100° C. The viscosity index of oils containing sufficient wax to render the measurement of a viscosity at 40° C. difficult or impossible may be determined by an extrapolation method, such as by measuring the viscosity of the oil at two temperatures at which the oil is fluid, e.g. 70° C. and 100° C., with the viscosity at 40° C. being estimated by using an extrapolation procedure, such as the one described in ASTM D341-89.

Unless otherwise specified, the viscosity index as used herein is on a dewaxed basis. Oils having a pour point of greater than about 0° C. were solvent dewaxed prior to the viscosity index determination. A solvent dewaxing procedure suitable for determining viscosity index (dewaxed basis) is as follows: 300 grams of a waxy oil for which a viscosity index (dewaxed basis) was to be determined was diluted 50/50 by volume with a 4:1 mixture of methyl ethyl ketone and toluene which had been cooled to −20° C. The mixture was cooled at −15° C., preferably overnight, and then filtered through a Coors funnel at −15° C. using Whatman No. 3 filter paper. The wax was removed from the filter and placed in a tarred 2 liter flask. The solvent was then removed on a hot plate and the wax weighed. The viscosities of the dewaxed oil, measured at 40° C. and 100° C., were used to determine the viscosity index.

The sulfur content and the nitrogen content of the hydrotreated oil is reduced relative to those of the lube oil feedstock, and the viscosity index of the hydrotreated oil is increased relative to that of the lube oil feedstock. In general, the hydrotreated oil will contain less than about 100 ppm sulfur, and preferably less than 50 ppm sulfur and more preferably less than 20 ppm sulfur. Thus, the hydrotreated oil preferably has a sulfur content which is less than 50% and more preferably less than 25% of the sulfur content of the lube oil feedstock, i.e. the feedstock to the hydrotreater. It will further contain less than about 50 ppm nitrogen, and preferably less than about 25 ppm nitrogen.

The effluent from the hydrotreating step typically contains a gaseous portion comprising hydrogen and light hydrocarbon reactor products, and lesser amounts of ammonia and hydrogen sulfide, and a liquid portion of hydrotreated oil, comprising reacted and unreacted hydrocarbonaceous products. Several options are available for dewaxing the hydrotreated oil, including (a) contacting the entire effluent in a dewaxing zone, with or without added hydrogen, with dewaxing catalyst; (b) separating the liquid and gaseous components, and contacting the liquid components with fresh hydrogen in a dewaxing zone; and (c) separating the liquid and gaseous components, removing contaminants from the gaseous portion, adding fresh hydrogen if needed to the purified gaseous portion, and contacting the resultant gaseous stream containing fresh hydrogen with the liquid portion in the dewaxing zone.

In the present process, at least a portion, and preferably the entire liquid portion, of the effluent from the hydrotreating step is contacted with a hydrodewaxing catalyst to reduce the pour point of the hydrotreated oil. The dewaxing reaction zone will typically be operated at a catalyst temperature of from about 400° F. (204° C.) to about 900° F. (482° C.), preferably within the temperature range of from about 550° F. (288° C.) to about 750° F. (399° C.). The reactor pressure will usually be within the range of from about 50 to about 3000 psig (0.45–20.8 MPa), preferably within the range of from about 500 to about 2500 psig (3.55–17.3 MPa). The liquid hourly space velocity (LHSV) will usually fall within the range of from about 0.1 to about 5 $hr^{-1}$ (V/V), with a range of about 0.5 to 2 $hr^{-1}$ being preferred. The dewaxed lube base oils will have a pour point less than that of the hydrotreated oils from which they are made. Preferably, the pour point of the dewaxed lube base oils will be less than about 5° C., more preferably less than about 0° C., and still more preferably less than about −5° C.

The addition of hydrogen into the dewaxing units, while not essential, is preferred. When hydrogen is used it is generally added in the range of from about 500 to about 10,000 standard cubic feet per barrel of feed (SCF/B) (89.1–1780 std $m^3$ $H_2/m^3$ oil), preferably within the range of from about 1000 to about 5000 SCF/B (178–891 std $m^3H_2/m^3$ oil). The preferred hydrogen feed to the dewaxing units will be substantially free of sulfur compounds, i.e. containing less than 250 ppm $H_2S$. At least a portion of the hydrogen feed to the dewaxer unit may contain a portion of the gaseous effluent recovered from the hydrotreating unit, which has been treated, e.g. by scrubbing with an aqueous amine solution, to remove a substantial portion of the $H_2S$ contained therein.

The dewaxing catalyst comprises an intermediate pore size molecular sieve. There are a number of catalysts which may be useful for the dewaxing step. Examples of intermediate pore size silicaceous crystalline molecular sieves include zeolites such as members of the ZSM family, e.g., ZSM-5, ZSM-11, ZSM-12, ZSM-21, ZSM-23, ZSM-35, ZSM-38 and SSZ-32. ZSM-5 is described in U.S. Pat. Nos. 3,700,585, 3,702,886 and 3,770,614; ZSM-11 is described in U.S. Pat. No. 3,709,979; ZSM-12 is described in U.S. Pat. No. 3,832,449; ZSM-21 and ZSM-38 are described in U.S. Pat. No. 3,948,758; ZSM-23 is described in U.S. Pat. No. 4,076,842; and ZSM-35 is described in U.S. Pat. No. 4,016,245. Dewaxing processes using SSZ-32 are described in, for example, U.S. Pat. Nos. 5,053,373; 5,252,527; 5,300,210; 5,397,454; 5,376,260, the disclosures of which are incorporated herein by reference for all purposes.

Isomerization catalysts useful in the present invention also include non-zeolitic molecular sieves having intermediate size pores. Non-zeolitic molecular sieves are microporous compositions that are formed from $AlO_2$ and $PO_2$ tetrahedra and have electrovalently neutral frameworks. See U.S. Pat. No. 4,861,743.

Non-zeolitic molecular sieves include aluminophosphates ($AlPO_4$) as described in U.S. Pat. No. 4,310,440, silicoaluminophosphates (SAPO), metalloaluminophosphates (MeAPO), and nonmetal substituted aluminophosphates (EIAPO). Metalloaluminophosphate molecular sieves that may be useful as isomerization catalysts are described in U.S. Pat. Nos. 4,500,651; 4,567,029; 4,544,143; and 4,686,093. Nonmetal substituted aluminophosphates are described in U.S. Pat. No. 4,973,785. Preferably the isomerization catalyst will contain an intermediate pore silicoaluminophosphate or SAPO as the non-zeolitic molecular sieve component. Intermediate pore SAPO's which are particularly useful in carrying out the present invention include SAPO- 11, SAPO-31, and SAPO-41. U.S. Pat. No. 4,440,871 describes SAPO's generally and SAPO-11, SAPO-31, and SAPO-41 specifically. The relevant parts of U.S. Pat. No. 4,440,871 relating to intermediate pore SAPO's are herein incorporated by reference. Dewaxing processes using the one or more of the SAPO family of molecular sieves as dewaxing/isomerization catalysts are disclosed in, for example, U.S. Pat. No. 4921594; 5,282,958; 5,413,695; 5,246,566; the disclosures of which are incorporated herein by reference for all purposes. While the intermediate pore size silicoaluminate zeolites, such as the ZSM family, dewax by a different mechanism than do the silicoaluminophosphate molecular sieves, both are useful for the present invention.

The preferred intermediate pore isomerization silicoaluminophosphate molecular sieve present in the isomerization catalyst is SAPO-11. When combined with a hydrogenation component, SAPO-11 converts the waxy components to produce a lubricating oil having excellent yield, very low pour point, low cloud point, low viscosity and high viscosity index. The hydrogenation component of the isomerization catalyst will be a Group VIIIA metal, metal compound or combination of Group VIIIA metals or metal compounds. Most preferably, the hydrogenation component will include either platinum or palladium or a combination of these metals or their compounds. The hydrogenation components are added to the catalyst by methods well known to those skilled in the art, such as by impregnation or the like. The metals are typically added to the catalyst as a soluble compound by impregnation after which the impregnated catalyst is air dried and calcined. The most preferred intermediate pore SAPO for use in the present invention is SM-3 which has a crystalline structure falling within that of the SAPO-11 molecular sieves. The preparation of SM-3 and its unique characteristics are described in U.S. Pat. No. 5,158,665 which is herein incorporated by reference.

The phrase "intermediate pore size" when referring to the zeolites or the SAPO's used in carrying out the present invention means an effective pore aperture in the range from about 5.3 to about 6.5 angstroms when the porous inorganic oxide is in the calcined form. Molecular sieves, including zeolites and SAPO's, in this range tend to have unique molecular sieving characteristics. Unlike small pore zeolites such as erionite and chabazite, they will allow hydrocarbons having some branching into the molecular sieve void spaces. Unlike larger pore zeolites such as faujasites and mordenites, they can differentiate between n-alkanes and slightly branched alkanes, and larger branched alkanes having, for example, quaternary carbon atoms.

The effective pore size of the molecular sieves can be measured using standard adsorption techniques and hydrocarbonaceous compounds of known minimum kinetic diameters. See Breck, *Zeolite Molecular Sieves,* 1974 (especially Chapter 8); Anderson, et al., J. Catalysis 58, 114 (1979); and U.S. Pat. No. 4,440,871, the pertinent portions of which are herein incorporated by reference.

In preparing catalysts for use in the present invention, the intermediate pore aluminosilicate zeolites and intermediate pore SAPO's may be used without additional forming, but usually the zeolite and SAPO's are composited with other materials resistant to the temperatures and other conditions employed in hydrocarbon conversion processes. Such oxide support materials may include active and inactive materials and synthetic or naturally occurring zeolites as well as alumina, clays, silica, and metal oxides. The latter may occur naturally or may be in the form of gelatinous precipitates, sols, or gels, including mixtures of silica or alumina oxides. Use of other active materials in association with the intermediate pore zeolite or intermediate pore SAPO may be present to improve the conversion or selectivity of the catalyst in certain hydrocarbon conversion processes. Inactive materials can be used to serve as diluents in order to control the amount of conversion in a given process. Frequently binders, such as naturally occurring clays and inorganic oxides, may be present to improve the crush strength of the catalyst.

In addition to the foregoing materials, the intermediate pore zeolite or intermediate pore SAPO may be composited with a porous oxide support material such as aluminum phosphate, silica-alumina, silica-magnesia, silica-zirconia, silica-thoria, silica-beryllia, silica-titania as well as tertiary compositions such as silica-alumina-thoria, silica-alumina-zirconia, silica-alumina-magnesia, and silica-magnesia-zirconia. The relative proportions of finely ground intermediate pore zeolite or intermediate pore SAPO to the support material varies widely, generally the crystal will fall within the range of 1 to 90% by weight of the catalyst. The methods for preparing the catalyst compositions are well known to those skilled in the art and include such conventional techniques as spray drying, extrusion, and the like.

The dewaxed effluent from the hydrodewaxing step comprises a low pour point material, having a pour point of less than about 5° C., preferably less than about 0° C. and most preferably less than about −5° C., and having a viscosity, measured at 100° C., of greater than about 2 cSt.

Such low pour point material is suitably reacted in a hydrogenation reaction zone over a hydrogenation catalyst comprising one or more noble metals on an inorganic oxide support. The hydrogenation step is desirable for removing, for example aromatic compounds and at least some of the remaining sulfur and nitrogen compounds, and any other components of the dewaxed effluent which may be a source of instability in the finished oil.

The hydrogenation reaction takes place in the presence of hydrogen, preferably at hydrogen pressures in the range of between about 500 psia and 4000 psia (3.4–33.8 MPa), more preferably in the range of about 900 psia to about 3000 psia (6.2–20.7 MPa). Hydrogenation reaction temperatures are generally within a range of about 400° F. (204° C.) to about 650° F. (343° C.). For many mild hydrogenation processes, in order to saturate aromatics and remove color bodies from the oil, hydrogenation reaction temperatures between about 400° F. (204° .C) and about 500° F. (260° C.) are suitable. The feed rate to the hydrogenation catalyst system is in the range of from about 0.2 to about 1.5 LHSV, preferably in the range of about 0.2 to about 1.0 LHSV, more preferably in the range of 0.3 to 0.7 LHSV. The hydrogen supply (makeup and recycle) is in the range of from about 500 to about 20,000 standard cubic feet per barrel (89.1–3562.6 std $m^3$ $H_2/m^3$ oil) of lubricating oil base stock, preferably in the range of from about 2000 to about 20,000 standard cubic feet per barrel (356–3560 std $m^3$ $H_2/m^3$ oil). Such a hydrogenation process is disclosed, for example, in U.S. Pat. Nos. 4,162,962 and 5,393,408, the entire disclosures of which are incorporated herein by reference for all purposes.

In the hydrogenation step the dewaxed oil is contacted with a catalyst comprising one or more noble metals, such as platinum, palladium, rhenium, rhodium, ruthenium or iridium, on an inorganic oxide matrix.

In a preferred embodiment, the present hydrogenation catalyst is a macroporous hydrogenation catalyst having a total pore volume greater than about 0.45 $cm^3/g$, preferably greater than about 0.55 $cm^3/g$, with at least about 1%, and preferably at least about 3%, of the total pore volume being in macropores of diameter of greater than about 1000 angstroms, with the minimum amount of macropore volume preferably being greater than 0.07 $cm^3/g$. As used herein, the term "macroporous" refers to a catalyst having a relatively large amount of pore volume, i.e., at least 1% in pores of diameter greater than about 1000 Angstroms, with a minimum macropore volume preferably being greater than 0.07 $cm^3/g$.

One such macroporous hydrogenation catalyst which is suitable for the invention is described in U.S. Pat. No. 5,393,408, the entire disclosure of which is incorporated herein by reference for all purposes. A particularly preferred hydrogenation catalyst comprises a platinum/palladium alloy having a platinum/palladium molar ratio of between 2.5:1 and 1:2.5, or between 2:1 and 1:1.5. The preferred inorganic oxide matrix is alumina. This particularly preferred hydrogenation catalyst and its preparation is disclosed in copending U.S. patent application entitled Sulfur Resistant Hydroconversion Catalyst and Hydroprocess Of Sulfur-Containing Lube Feedstock, docket number T-5244A, the entire disclosure of which is incorporated herein by reference for all purposes.

In addition, the hydrogenation catalyst may contain additional cracking components, to facilitate the hydrogenation process and/or to increase the fouling resistance of the hydrogenation catalyst. Such cracking components may include one or a combination of silica-alumina, titania, magnesia and a zeolite. Preferred zeolites include Y-type zeolites having a bulk $SiO_2/Al_2O_3$ molar ratio of greater than 12 and a unit cell size of less than 24.5 angstroms, preferably less than about 24.35 angstroms.

The following examples will help to further illustrate the invention but are not intended as a limitation to the scope of the process.

EXAMPLES

Example 1

A hydrotreating catalyst was prepared as follows: 1009 grams (volatile free basis) Katalco's GAP-50 alumina were combined with 20 grams of 70% nitric acid and 750 grams deionized water and mixed for 30 minutes at 131° F. (55° C.). One gram of concentrated ammonia hydroxide dissolved in 100 grams of deionized water was then added to the alumina mixture, and the resultant mixture mixed an additional 15 minutes at 131° F. (55° C.). The alumina mixture was extruded through a 0.0769 inch template and the extrudate dried for two hours at 250° F. (121° C.), for two hours at 400° F. (204° C.), and for one hour at 1500° F. (816° C.).

Hydrogenation metals were added to the extrudates as follows: 206 grams (volatile-free basis) of the extrudate were impregnated with a solution containing 19.6 grams nickel carbonate and 288 grams phosphomolybdic acid solution (14.6% molybdenum, 4.0% phosphorous) at 120° F. (49° C.). After standing for 20 minutes, the impregnated extrudates were dried at 200° F. (93° C.) for four hours and calcined at 950° F. (510° C.).

Example 2

A SAPO-11 containing catalyst was prepared as follows:

231.2 g of 85% $H_3PO_4$ were added to 118 g of distilled $H_2O$ in a Teflon beaker, with the beaker in an ice bath. 408.4 g of aluminum isopropoxide (Al-$[OC_3H_7]_3$) were slowly added with mixing and then mixed until homogeneous. Then 38 g of fumed silica (Cabosil M-5) in 168 g of distilled water were added with mixing. Next, 91.2 g of di-n-propylamine ($Pr_2NH$) were added followed by mixing with a Polytron. The mixture had a pH of 6.0 and the following composition, expressed in molar ratios of oxides:

$$0.9\ Pr_2NH{:}0.6\ SiO_2{:}\ Al_2O_3\ P_2O_5{:}18\ H_2O$$

The mixture was placed in a Teflon bottle in a stainless steel pressure vessel and heated for 5 days at 200° C. with no stirring and autogenous pressure. The supernatant liquid was removed and the product was filtered, washed with water, dried overnight at 127° C., and calcined in air for 8 hours at 538° C. The average crystallite size was less than 0.5 micron.

X-Ray diffraction analysis showed the calcined sieve to be SAPO-11, and elemental analysis showed it to have the following bulk anhydrous molar composition:

$$0.38\ SiO_2{:}Al_2O_3\ P_2O_5$$

Example 3

A dewaxing catalyst containing 65% SSZ-32 on an alumina support was prepared as follows:

1400 ml of water and 56.5 grams KOH were mixed in a Hastelloy C lined 1-gallon autoclave, which was stirred with an overhead paddle-blade stirrer. 23.3 grams of Reheis F2000 alumina (50 wt % $Al_2O_3$) were added, and the mixture stirred until clear. 62 grams of isobutylamine and 200 millimoles of N,N' Diisopropylimidazolium hydroxide (1M aqueous solution) were then added. 253 grams of Cabosil M-5 were then added in increments with stirring. After additional 30 minutes of stirring, the pH of the mixture was 13.2–13.3.

The reaction mixture was stirred at 75 RPM and heated to 170° C. for 5 days. After washing and drying the reaction product, the product was analyzed by X-Ray diffraction and found to be SSZ-32.

The uncalcined zeolite was bound with alumina as follows: 180 grams of zeolite was blended with 97 grams Catapal alumina in a Baker Perkins mixer. To the mixing powders was added 8.3 g of 70% $HNO_3$ in sufficient water so that the total of water in the zeolite, in the alumina, and with the $HNO_3$ was 269 g. The mixing powders containing the nitric acid was mixed for 30 minutes at a total volatiles content of approximately 45% and was then extruded with a 0.113 in die. The extrudates were dried at 250° F. (about 121° C.) for 8 hours and calcined at 1150° F. (about 621° C.) for 1 hour at SCFH (i.e., standard cubic feed per hour) dry air. The extrudates were then subjected to a sequence of 4 $NH_4NO_3$ ion-exchanges in a 1M solution, each for 2 hours at 100° C.

The bound exchanged zeolite was impregnated with 0.325 wt % platinum from platinum tetraaminonitrate as follows: A platinum solution was prepared by combining 6.44 grams $Pt(NH_3)_4(NO_3)_2$ with 337 grams water and 48.2 grams of dilute $NH_4OH$ (1/100 volume dilution of concentration of $NH_4OH$ containing 28.5% $NH_3$). A slurry was also prepared by combining 100 grams zeolite (volatiles-free basis) with 1048 grams deionized water and 201 grams of 1/100 diluted $NH_4OH$. The zeolite slurry was contacted with the platinum solution for 24 hours. The zeolite slurry was then filtered, washed by reslurrying twice with a 10/1 weight ration of deionized water, air dried for 30 minutes, and dried at 250° F. (about 121° C.) for 4 hours in forced air. The zeolite was then calcined at 250° F. (about 121° C.) for 2 hours and then heated at 100° F./hr (about 56° C./hr) to 550° F. (about 288° C.), and held at 550° F. (about 288° C.) for 3 hours in 1 SCFH dry air.

Before testing the catalyst, it was reduced in flowing hydrogen at 400° F. (about 204° C.) and 2300 psig (16.0 MPa) pressure for 4 hours in order to equilibrate activity.

Example 4

A hydrogenation catalyst was prepared as follows:

To prepare a support for the hydrogenation catalyst, a dry mixture of 1.32 kg volatiles-free Condea Plural SB alumina powder, 10.68 kg volatiles-free Condea Siral 40 silica/alumina powder (40 weight percent $SiO_2$) and 360 grams Dow Chemical Company Methocel F4M powder were blended in a Littleford mixer. The blended powders were then wetted with a spray of 11.0 kg of deionized water, and 3.21 kg of nitric acid (0.171 kg of 70% $HNO_3$ in 3.039 kg deionized water) were sprayed on the wetted powder to peptize the powders. The peptized powders were then mixed an additional 10 minutes. A portion of the peptized mixture was then extruded in a Bonnet mixer through a 0.073 inch die plate. The extrudates were dried in flowing dry air at 150° F. (66° C.). for 30 minutes, then at 200° F. (93° C.) for 30 minutes, then at 300° F. (149° C.) for 1 hour, and then calcined by heating in 20 $ft^3$/hr dry air to 1100° F. (593° C.) at 500° F. (260° C.)/hour, then to 1300° F. (704° C.) at 300° F. (149° C.)/hour, and then holding at 1300° F. (704° C.) for 1 hour before cooling.

This support had the properties shown in Table I.

TABLE I

| | Physical Property |
|---|---|
| Particle Density | 0.940 $g/cm^3$ |
| Total Pore Volume | 0.5957 $cm^3/g$ |
| Macro Pore Volume | 0.123 $cm^3/g$ |

As used herein, macropore sized pores have greater than 1000 angstrom effective diameters.

A hydrogenation catalyst with platinum and palladium was prepared using 400 grams (volatiles-free basis) of a hydrogenation catalyst support which has been equilibrated overnight at ambient conditions. A platinum and palladium solution was prepared by dissolving 1.59 grams of tetraamine platinum nitrate $(Pt(NH_3)_4(NO_3)_2$ and 0.64 grams of tetraamine palladium nitrate $(Pd(NH_3)_4(NO_3)_2$ in deionized water which contained sufficient $NH_4OH$ to maintain a pH in the range of 9.3–10.0.

The equilibrated macroporous catalyst support was impregnated with the platinum and palladium solution by spray pore fill to a nominal loading of 0.2 weight percent Pt and 0.16 weight percent Pd on the finished catalyst. Enough platinum and palladium solution was sprayed onto the support over a period of 10 to 15 minutes to fill the pore volume of the support. The support was then allowed to soak for 4 hours, with additional shaking each 30 minutes. During the soak, water was added as required to the support to keep it damp. After soaking overnight, the impregnated support was dried for 2 hours at 140 ° C. in a forced-convection oven under flowing air, followed by 2 hours at 100° C. After drying, the catalyst was loaded into two muffle pots at a depth of 1 ¼ inches and shock calcined at 850° F. (454° C.) in 4 $ft^3$/hr dry air in a furnace for 45 minutes.

Example 5

A commercial nickel/molybdenum on alumina hydrotreating catalyst similar to the catalyst of Example 1 was used to hydrotreat a straight run lube oil feedstock, having the physical properties shown in Table II, at 680° F. (360° C.), 1500 psia (10.3 MPa) total pressure, and 0.5 $h^{-1}$ LHSV. The hydrotreated product was designated Sample A.

TABLE II

| Hydrotreating Reaction Conditions | | |
|---|---|---|
| Temperature, ° F. (° C.) | | 680 (360) |
| Total Pressure, psig (MPa) | | 1500 (10.4) |
| Hydrogen partial pressure, psia | | 1310 |
| Recycle rate, scf/bbl (std $m^3$ $H_2/m^3$ oil) | | 3000 (534) |
| LHSV, $hr^{-1}$ | | 0.5 |
| | Feed | Product (Sample A) |
| Sulfur | 2.57 wt % | 41 ppm |
| Nitrogen, ppm | 791 | 1.06 |
| Aromatics, wt % | 54.3 | 22.7 |
| Saturates, wt % | 44.3 | 77.2 |
| Vis @ 100 C., cSt | 9.696 | 5.901 |
| VI (dewaxed basis) | 54 | 89 |
| Pour Pt | 38° C. | 35° C. |
| Sim. Dist., D-2887 (liquid volume %), ° F. (° C.) | | |
| 10% | 792 (422) | 642 (339) |
| 50% | 879 (471) | 838 (448) |
| 90% | 958 (514) | 938 (503) |

A similar feed which had been pretreated by mild solvent extraction was hydrotreated using a commercial nickel/molybdenum on alumina hydrotreating catalyst similar to the catalyst of Example 1. Feed and product properties are tabulated in Table III. Hydrotreated products were designated Samples B–E.

TABLE III

| Reaction Conditions | | | | |
|---|---|---|---|---|
| Temperature, ° F. (° C.) | 637 (336) | 634 (334) | 629 (332) | 634 |
| Total Pressure, psig | 1050 (7.3) | 1050 | 1050 | 1050 |
| Hydrogen partial pressure, psia | 920 (6.3) | 920 | 920 | 920 |
| Recycle rate, scf/bbl (std $m^3$ $H_2/m^3$ oil) | 3000 (534) | 3000 | 3000 | 3000 |
| LHSV, $hr^{-1}$ | 0.5 | 0.5 | 0.5 | 0.5 |

| | Feed | Product (Sample B) | Product (Sample C) | Product (Sample D) | Product (Sample E) |
|---|---|---|---|---|---|
| Sulfur | 1.37 wt % | 45 ppm | 97 ppm | 215 ppm | 89 ppm |
| Nitrogen, ppm | 124 | 0.17 | 0.67 | 1.54 | 0.42 |
| Aromatics, wt % | 46.0 | 20.1 | 23.2 | 26.5 | 22.8 |
| Saturates, wt % | 52.4 | 79.9 | 76.6 | 73.2 | 77.0 |
| Vis @ 100 C., cSt | 8.466 | 6.406 | 7.094 | 7.449 | 7.068 |
| VI (dewaxed basis) | 86 | 102 | 97 | 94 | 97 |
| Pour Pt | 41 | 10 | 38 | 39 | 35 |
| Simulated Distillation, D-2887 (liquid volume %), ° F. (° C.) | | | | | |
| 10% | 811 (433) | 737 (392) | 768 (409) | 775 (413) | 764 (407) |
| 50% | 885 (474) | 865 (463) | 872 (467) | 873 (467) | 905 (485) |
| 90% | 957 (514) | 952 (511) | 955 (513) | 956 (513) | 952 (511) |

A similar feed which had been pretreated at normal solvent extraction conditions was hydrotreated using a commercial nickel/molybdenum on alumina hydrotreating catalyst similar to the catalyst of Example 1. Feed and product properties are tabulated in Table IV. The hydrotreated product was designated Sample F.

TABLE IV

| Hydrotreating Reaction Conditions | | |
|---|---|---|
| Temperature, ° F. (° C.) | | 639 (337) |
| Total Pressure, psig (MPa) | | 1400 (9.7) |
| Hydrogen partial pressure, psia (MPa) | | 1230 (8.5) |
| Recycle rate, scf/bbl (std $m^3$ $H_2/m^3$ oil) | | 3000 (534) |
| LHSV, $hr^{-1}$ | | 1.0 |
| | Feed | Product (Sample F) |
| Sulfur | 0.93 wt % | 19 ppm |
| Nitrogen, ppm | 49 | 0.13 |
| Aromatics, wt % | 22.7 | 11.4 |
| Saturates, wt % | 77.2 | 88.6 |
| Vis @ 100 C., cSt | 5.901 | 6.052 |
| VI | 89 | 107 |
| Pour Pt | 35° C. | 43° C. |
| Sim. Dist., D-2887 (liquid volume %), ° F. (° C.) | | |
| 10% | 642 (339) | 735 (391) |
| 50% | 868 (464) | 865 (463) |
| 90% | 938 (503) | 953 (512) |

Example 6

Hydrotreated product E (Table III) was dewaxed over a SAPO-11 containing catalyst, bound with 35% Catapal alumina and impregnated with 0.35% platinum, at 648° F. (342° C.), 1.02 LHSV, 3000 scf/bbl recycle hydrogen rate (534 std $m^3$ $H_2/m^3$ oil), and 1105 psig (7.7 MPa) total pressure. The properties of the dewaxed oil are shown in Table V.

TABLE V

| Feed | Sample E Product Properties |
|---|---|
| Nitrogen, ηg/μl | 0.16 |
| Aromatics, wt % | 7.8 |
| Saturates, wt % | 92.2 |
| Vis @ 100 C., cSt | 6.849 |
| VI | 107 |
| Pour Pt, ° C. | −9 |
| Simulated Distillation, D-2887 (liquid volume %), ° F. (° C.) | |
| 10% | 751 (399° C.) |
| 50% | 863 (462° C.) |
| 90% | 954 (512° C.) |

Example 7

Hydrotreated oils were dewaxed over a catalyst containing 65% SSZ-32 on an alumina support. The dewaxed product was then hydrogenated over a hydrogenation catalyst of Example 4. Reaction conditions and product properties are tabulated in Table VI.

TABLE VI

| Feed | Sample B | Sample C | Sample D | Sample A |
|---|---|---|---|---|
| | Reaction Conditions | | | |
| Temperature, ° F. (° C.) (Dewaxing) | 637 (336) | 620 (327) | 628 (331) | 600 (316) |
| Temperature, ° F. (° C.) (Hydrogenation) | 450 (232) | 450 | 450 | 450 |
| Total Pressure, psig (MPa) | 1112 (7.8) | 1106 (7.7) | 1102 (7.7) | 1103 (7.7) |
| Recycle rate, scf/bbl (std $m^3$ $H_2/m^3$ oil) | 4054 (722) | 4011 (715) | 3985 (710) | 4212 (750) |
| LHSV, $hr^{-1}$ (Dewaxing) | 1.0 | 1.0 | 1.0 | 0.94 |
| LHSV, $hr^{-1}$ (Hydrogenation) | 1.0 | 1.0 | 1.0 | 1.0 |
| Product Properties | | | | |
| Aromatics, wt % | 5.8 | 23.2 | 14.8 | 6.4 |
| Saturates, wt % | 97.1 | 94.2 | 85.1 | 93.6 |
| Vis @ 100 C., cSt | 7.279 | 7.929 | 8.233 | 7.034 |
| VI | 103 | 99 | 95 | 92 |
| Pour Pt | −12 | −13 | −12 | −9 |
| Stimulated Distillation, D-2887 (liquid volume %), ° F. (° C.) | | | | |
| 10% | 752 (400) | 773 (412) | 695 (368) | |
| 50% | 865 (463) | 871 (466) | 842 (450) | |
| 90% | 952 (511) | 955 (513) | 939 (504) | |

The examples above illustrate the effectiveness of the present process for preparing high quality lubricating oil base stock from high sulfur feeds.

Example 8

Hydrotreated product A (Table II) was dewaxed over a SAPO-11 containing catalyst followed by a hydrogenation catalyst similar to the catalyst of Example 4 but containing 0.475 wt % Pd as the only hydrogenation component. The properties of the dewaxed/hydrogenated oil are shown in Table VII. This example illustrates that a hydrogenation catalyst containing a conventional hydrogenation component produces a lower quality oil in terms of aromatic content than oil produced using the present process.

TABLE VII

| | Sample A Reaction Conditions |
|---|---|
| Temperature, ° F. (° C.) (Dewaxing) | 675 (357) |
| Temperature, ° F. (° C.) (Hydrogenation) | 450 (232) |
| Total Pressure, psig (MPa) | 1102 (7.7) |
| Recycle rate, scf/bbl (std $m^3$ $H_2/m^3$ oil) | 4780 (852) |
| LHSV, $hr^{-1}$ (Dewaxing) | 1.07 |
| LHSV, $hr^{-1}$ (Hydrogenation) | 1.0 |
| Product Properties | |
| Aromatics, wt % | 12.5 |
| Saturates, wt % | 87.5 |
| Vis @ 100 C., cSt | 6.485 |
| VI | 97 |
| Pour Pt | 15 |
| Stimulated Distillation, D-2887 (liq volume %) | |
| 10% | 707 |
| 50% | 839 |
| 90% | 939 |

What is claimed is:

1. A process for producing a lubricating oil base stock comprising:

a) contacting a petroleum feedstock which has a normal boiling point in the range of about 600° F. (316° C.) to about 1250° F. (677° C.) in a hydrotreating reaction zone with a hydrotreating catalyst at a hydrogen partial pressure of less than about 1600 psia (11 MPa) and a temperature between about 500° F. (260° C.) and about 800° F. (427° C.) to produce a hydrotreated oil having a viscosity index which is at least about 5 greater than the viscosity index of the petroleum feedstock and a viscosity measured at 100° C. of at least about 2 cSt;

b) contacting the hydrotreated oil at hydrodewaxing conditions in a dewaxing reaction zone with an intermediate pore size molecular sieve catalyst to produce a dewaxed oil having a pour point lower than the pour point of the hydrotreated oil; and c) contacting the dewaxed oil at hydrogenation conditions in a hydrofinishing reaction zone with a hydrogenation catalyst comprising a platinum/palladium alloy to produce a lubricating oil base stock, wherein the platinum/palladium molar ratio of the platinum/palladium alloy is between about 2.5:1 and about 1:2.

2. The process according to claim 1 wherein the platinum/palladium molar ratio of the platinum/palladium alloy is between about 2.0:1 and about 1:1.5.

3. The process according to claim 1 wherein the hydrogen partial pressure in the hydrotreating reaction zone is less than about 1250 psia (8.6 MPa).

4. The process according to claim 3 wherein the hydrogen partial pressure in the hydrotreating reaction zone is less than about 1100 psia (7.6 MPa).

5. The process according to claim 1 wherein the temperature in the hydrotreating reaction zone is in the range of about 600° F. (316° C.) to about 700° F. (371° C.).

6. The process according to claim 1 wherein the intermediate pore size molecular sieve catalyst comprises a zeolite selected from the group consisting of ZSM-5, ZSM-11, ZSM-12, ZSM-21, ZSM-23, ZSM-35, ZSM-38 and SSZ-32.

7. The process according to claim 6 wherein the intermediate pore size molecular sieve catalyst comprises SSZ-32.

8. The process according to claim 1 wherein the intermediate pore size molecular sieve catalyst comprises a molecular sieve selected from the group consisting of SAPO-11, SAPO-5, SAPO-31, SAPO-41.

9. The process according to claim 8 wherein the intermediate pore size molecular sieve catalyst comprises SAPO-11.

10. The process according to claim 1 wherein the petroleum feedstock has a normal boiling point in the range of about 800° F. (427° C.) to about 1250° F. (677° C.).

11. The process according to claim 1 wherein the hydrotreated oil has a viscosity index of greater than about 70.

12. The process according to claim 11 wherein the hydrotreated oil has a viscosity index of greater than about 90.

13. The process according to claim 12 wherein the hydrotreated oil has a viscosity index of greater than about 115.

14. The process according to claim 1 wherein the petroleum feedstock is a raffinate derived from a solvent extraction process.

15. The process according to claim 1 wherein the petroleum feedstock is derived from a VGO.

16. The process according to claim 1 wherein the petroleum feedstock is derived from a waxy feedstock comprising greater than about 50% by weight wax.

17. The process according to claim 1 wherein the lubricating oil base stock has a saturates content of greater than 90%, a sulfur content of less than or equal to 0.03% and a viscosity index of between 80 and 120.

18. The process according to claim 1 wherein the lubricating oil base stock has a saturates content of greater than 90%, a sulfur content of less than or equal to 0.03% and a viscosity index of greater than 120.

19. The process according to claim 1 to produce the hydrotreated oil having a viscosity index of at least $VI_H$, wherein $$\frac{(VI_H - VI_o)}{\Delta C} \geq 1.5.$$

$\Delta C$ is the conversion during the step of hydrotreating; and $VI_O$ is the viscosity index of the petroleum feedstock.

20. The process according to claim 19 wherein:

$$\frac{(VI_H - VI_0)}{\Delta C} \geq 2.0.$$

21. The process according to claim 1 wherein the hydrotreating conditions are selected to maintain a volumetric cracking conversion during hydrotreating of less than about 20% by volume.

22. The process according to claim 1 wherein the hydrotreating conditions are selected to maintain a volumetric cracking conversion during hydrotreating of less than about 10% by volume.

23. The process according to claim 1 wherein the hydrotreated oil contains less than 50 ppm sulfur.

24. A process for producing a lubricating oil base stock comprising:

a) contacting a petroleum feedstock which has a normal boiling point in the range of about 600° F. (316° C.) to about 1250° F. (677° C.) in a hydrotreating reaction zone with a hydrotreating catalyst at a hydrogen partial pressure of less than about 1250 psia (8.6 MPa) to produce a hydrotreated oil having a viscosity index of at least $VI_H$, wherein $$\frac{(VI_H - VI_o)}{\Delta C} \geq 1.5.$$

$\Delta C$ is the conversion during the step of hydrotreating; and $VI_O$ is the viscosity index of the petroleum feedstock;

b) contacting the hydrotreated oil at hydrodewaxing conditions in a dewaxing reaction zone with an intermediate pore size molecular sieve catalyst to produce a dewaxed oil having a pour point lower than the pour point of the hydrotreated oil; and c) contacting the dewaxed oil at hydrogenation conditions in a hydrofinishing reaction zone with a hydrogenation catalyst comprising a noble metal hydrogenation component on an alumina base to produce a lubricating oil base stock.

25. The process according to claim 24 wherein the hydrogenation catalyst comprises a platinum/palladium alloy hydrogenation component, wherein the platinum/palladium molar ratio of the platinum/palladium alloy is between about 2.5:1 and about 1:2.

26. The process according to claim 24 wherein the intermediate pore size molecular sieve catalyst comprises SSZ-32.

27. The process according to claim 24 wherein the intermediate pore size molecular sieve catalyst comprises SAPO-11.

28. The process according to claim 24 wherein the petroleum feedstock has a normal boiling point in the range of about 800° F. (474° C.) to about 1250° F. (677° C.).

29. The process according to claim 24 wherein the hydrogen partial pressure in the hydrotreating reaction zone is less than about 1100 psia (7.6 MPa).

30. A process for producing a lubricating oil base stock comprising:

a) contacting a petroleum feedstock which has a normal boiling point in the range of about 600° F. (316° C.) to about 1250° F. (677° C.) in a hydrotreating reaction zone with a hydrotreating catalyst at temperature in the range of about 600° F. (316° C.) to about 700° F. (371° C.) to produce a hydrotreated oil having a viscosity measured at 100° C. of at least about 2 cSt and a viscosity index of at least $VI_H$, wherein $$\frac{(VI_H - VI_o)}{\Delta C} \geq 1.5.$$

$\Delta C$ is the conversion during the step of hydrotreating; and $VI_O$ is the viscosity index of the petroleum feedstock;

b) contacting the hydrotreated oil at hydrodewaxing conditions in a dewaxing reaction zone with an intermediate pore size molecular sieve catalyst to produce a dewaxed oil having a pour point lower than the pour point of the hydrotreated oil; and c) contacting the dewaxed oil at hydrogenation conditions in a hydrofinishing reaction zone with a hydrogenation catalyst comprising a platinum/palladium alloy to produce a lubricating oil base stock, wherein the platinum/palladium molar ratio of the platinum/palladium alloy is between about 2.5:1 and about 1:2.

31. The process according to claim 30 wherein the platinum/palladium molar ratio of the platinum/palladium alloy is between about 2.0:1 and about 1:1.5.

32. The process according to claim 31 wherein:

$$\frac{(VI_H - VI_0)}{\Delta C} \geq 2.0.$$

33.The process according to claim 32 wherein the lubricating oil base stock has a saturates content of greater than 90%, a sulfur content of less than or equal to 0.03% and a viscosity index of between 80 and 120.

34. The process according to claim 30 wherein the lubricating oil base stock has a saturates content of greater than 90%, a sulfur content of less than or equal to 0.03% and a viscosity index of between 80 and 120.

35.The process according to claim 34 wherein the intermediate pore size molecular sieve catalyst comprises SSZ-32.

36. The process according to claim 34 wherein the intermediate pore size molecular sieve catalyst comprises SAPO-11.

37. The process according to claim 30 wherein the petroleum feedstock comprises greater than about 50% by weight of wax, and wherein the lubricating oil base stock has a saturates content of greater than 90%, a sulfur content of less than or equal to 0.03% and a viscosity index of greater than 120.

38. The process according to claim 37 wherein the intermediate pore size molecular sieve catalyst comprises SSZ-32.

39. The process according to claim 37 wherein the intermediate pore size molecular sieve catalyst comprises SAPO-11.

40. A process for producing a lubricating oil base stock comprising upgrading a petroleum feedstock to produce a lube oil feedstock having a viscosity index higher than that of the petroleum feedstock; and reacting the lube oil feedstock at hydrotreating conditions selected to maintain a volumetric cracking conversion during hydrotreating of less than 20%, and a sulfur content of the hydrotreated oil of less than 50 ppm, wherein the change in viscosity index of the lube oil feedstock during hydrotreating, $(VI_H - VI_O)$ is such that $(VI_H - VI_O)/\Delta C$ is greater than 1.0, wherein $VI_H$ is the viscosity index of the hydrotreated oil, $VI_O$ is the viscosity index of the lube oil feedstock to the hydrotreater, and $\Delta C$ is the volumetric cracking conversion in the hydrotreater.

41. The process according to claim 40 wherein the volumetric cracking conversion during hydrotreating is maintained at less than 10%.

42. The process according to claim 41 wherein the volumetric cracking conversion during hydrotreating is maintained at less than 5%.

43. The process according to claim 41 wherein the sulfur content of the hydrotreated oil is less than 20 ppm.

44. The process according to claim 43 wherein the sulfur content of the hydrotreated oil is less than 10 ppm.

* * * * *